US005682776A

United States Patent [19]

Burt

[11] Patent Number: 5,682,776

[45] Date of Patent: Nov. 4, 1997

[54] ADJUSTABLE TOILET-LID CLOSING AND LOCK-DOWN DEVICE

[76] Inventor: Gene Doyle Burt, 11636 Watson Rd., Sandy, Utah 84092

[21] Appl. No.: 598,241

[22] Filed: Feb. 7, 1996

[51] Int. Cl.[6] ..... B65D 55/14

[52] U.S. Cl. ..... 70/159; 4/253; 292/189; 70/57

[58] Field of Search ..... 4/253; 70/57, 19, 70/158–159, 160, 161, 162, 163; 292/189, 146, 150

[56] References Cited

U.S. PATENT DOCUMENTS

| | | | |
|---|---|---|---|
| 153,673 | 8/1874 | Fox | 70/57 |
| 1,548,584 | 8/1925 | Dietrich | 70/19 |
| 2,575,401 | 11/1951 | Simmons | 70/211 |
| 3,056,972 | 10/1962 | Miller | 4/253 |
| 3,431,004 | 3/1969 | Schell | 4/253 |
| 4,395,784 | 8/1983 | Foster | 4/253 |
| 4,404,695 | 9/1983 | Camp | 4/253 |
| 4,507,813 | 4/1985 | Lawson et al. | 4/253 |
| 4,724,551 | 2/1988 | Gardner | 4/253 |
| 4,763,363 | 8/1988 | Lallemand | 4/253 |
| 4,833,737 | 5/1989 | Boucher et al. | 4/253 |
| 4,894,870 | 1/1990 | Buckshaw et al. | 4/253 |
| 4,930,166 | 6/1990 | Salloum | 4/253 |
| 5,003,641 | 4/1991 | Selman, Jr. | 4/253 |
| 5,347,663 | 9/1994 | Yost | 4/253 |

FOREIGN PATENT DOCUMENTS

| | | | |
|---|---|---|---|
| 2182383 | 5/1987 | United Kingdom | 292/348 |

*Primary Examiner*—Darnell M. Boucher

[57] ABSTRACT

An adjustable toilet-lid closing and lock-down device, with optional use key lock-down, for use on many different types, and styles of toilets, that is sturdily attached, keeping toilet-lid lock-down in it's normal position, requiring adult supervision to use, thus providing safety and general hygiene for infants, young children and household pets.

7 Claims, 2 Drawing Sheets

ADJUSTABLE TOILET-LID CLOSING AND LOCK-DOWN DEVICE

BACKGROUND OF THE INVENTION (1) Field of the Invention

The present invention relates to a toilet safety device. More specifically, present invention relates to an adjustable toilet-lid closing and lock-down device.

(2) Prior Art

In busy households and businesses of today, many responsible persons would welcome the fact that they could be assured, that in rooms with toilets that infants, young children, and household pets, having access to these toilets, that the toilet-lid would not stay up, unless assisted, and when not supported, (by an adult's hand, or a person's back when sitting on the toilet seat), the lid will return to down position, with the optional use of "key LOCK-DOWN". Thus acting as part of an overall deterrent, in which safety, and general hygiene are achieved. This gives responsible persons using this sturdily attached and adjustable device confidence and peace of mind in knowing a toilet-lid is down, and locked in place. Other devices do not accomplish in design, or objective, what this invention does in its design, and objective.

No device is known, however, for toilet-lid closing and key lock-down, that so completely, effectively, and safely achieves these objectives.

SUMMARY OF THE INVENTION (1) The principal object of the present invention is to provide an adjustable device, on a toilet, to limit the upward travel of the toilet-lid, and when the toilet-lid is not supported, will return to its down position, at which time, it is locked in place with optional use of "key LOCK-DOWN".

(2) It also is an object of the present invention to provide an adjustable device that can be sturdily attached to many different types and styles of toilet-lids, and toilet-bowls that is strong in construction.

(3) Another object of the present invention is to provide safety and general hygiene for infants, young children, and household pets which requires adult supervision to use the toilet with device attached.

(4) Another further object is to provide a device which is of simple, inexpensive construction.

A final object is to provide peace of mind to responsible persons using this device, as an added deterrent, in overall safety, and general hygiene, for infants, young children, and household pets.

The foregoing objects can be accomplished by providing an adjustable toilet-lid closing device, with optional use of "key LOCK-DOWN " device, whose major components are sturdily attached to the toilet-lid and toilet bowl.

In the preferred embodiment of the present invention, the device is formed by fitting the device's (2) two major components in directed places, on the top of the toilet-lid (component no. 1), and on the side of the toilet bowl (component no. 2). Then adjust the device for proper fit, according to the thickness of the toilet-lid and toilet bowl. This will determine mounting. After outlining (with erasable marker) where the device will be fitted on the toilet, clean areas with soap and water then dry and wipe down with isoprovl alcohol. Let the areas dry and then prepare and apply adhesive comprising of moldable putty adhesive to proper areas. On component no. 2 it will be attached to the side of the toilet bowl. Note: Using enough moldable putty adhesive to not only achieve desired bonding, but also create desired angle to accept the rod of component no. 1 that will fit into it.

With molded putty adhesive on proper area of component no. 2, place the complete device in outlined areas of the toilet-lid and bowl. The hands applying reasonable pressure to component no. 2 should create the desired angle needed and holding in place until the moldable putty adhesive sets, and holds to the toilet bowl (usually under 5 minutes at 70 degrees Fahrenheit). Then re-check for proper fit. Once the proper fit is achieved carefully remove component no. 1 from component no. 2. Let component no. 2 set/harden on side of toilet bowl for 24 hours, being careful not to disturb.

After 24 hours place component no. 1 on raised toilet-lid, holding it in place lower the lid, and let the "connector rod " enter the proper entry area of componet no. 2. Component no. 1 has (2) two pre-drilled holes. Take a drill with proper fitted drill bit and place it in the pre-drilled holes and drill through the toilet lid. Make sure the the drill bit does not go beyond the toilet lid. Then place washers and bolt them through the top of component no. 1, the toilet lid, the area washer, the lock washer, and nut to the bolt. Finally, tighten to reasonable torque.

DETAILED DESCRIPTION

Figure 1:
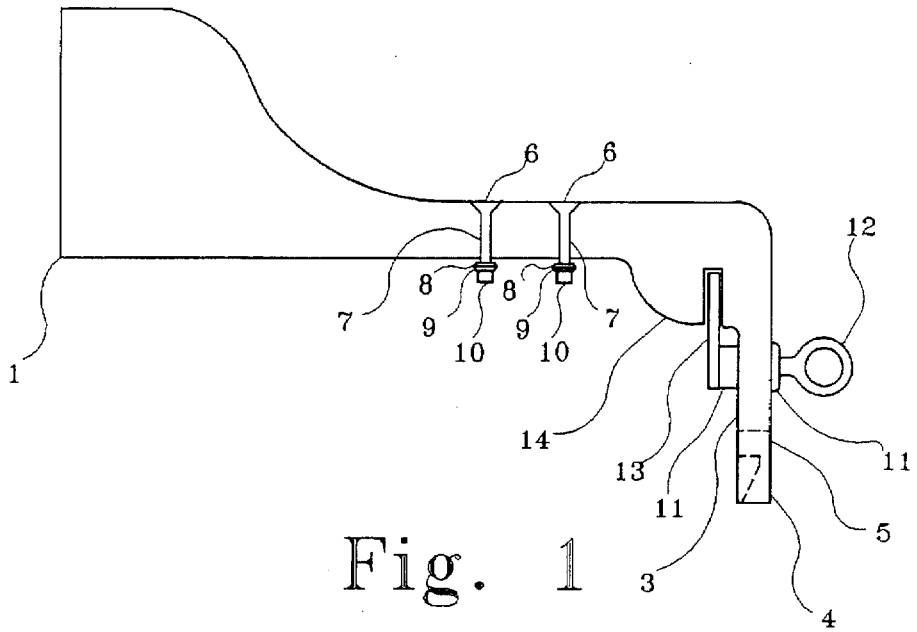
FIG. 1 is a side perspective of component #1 of a toilet-lid closing and lock-down device in accordance with present invention.
Figure 2:
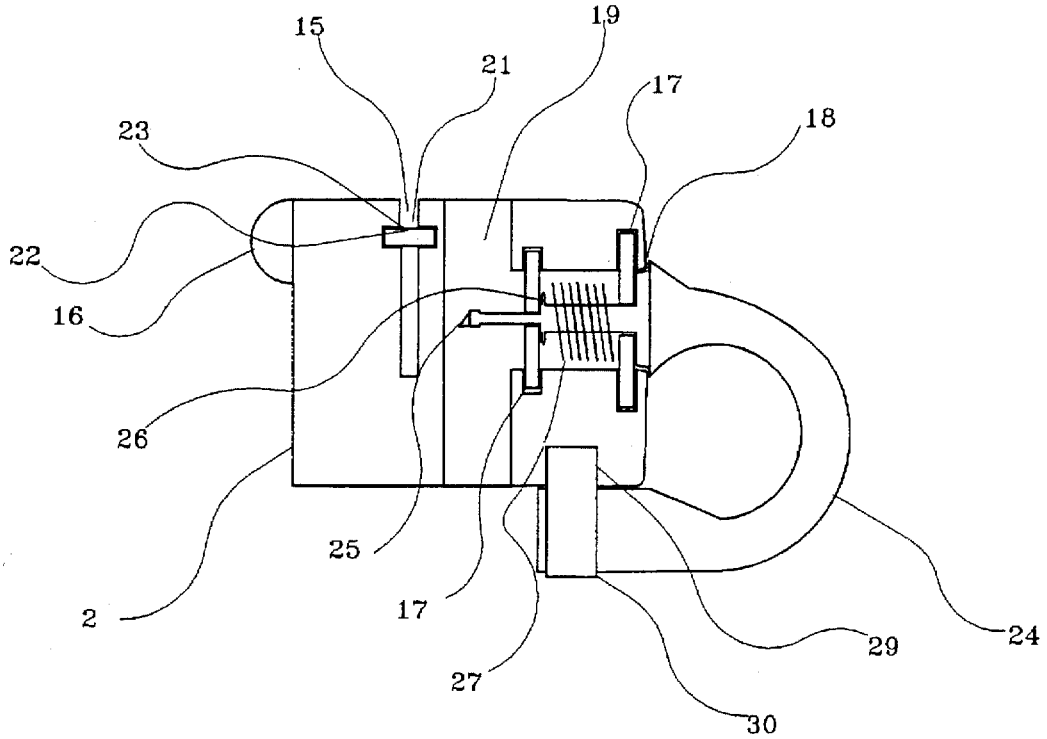
FIG. 2 is a side perspective of component #2 of a toilet-lid closing & lock-down device in accordance with present invention.
Figure 3A:
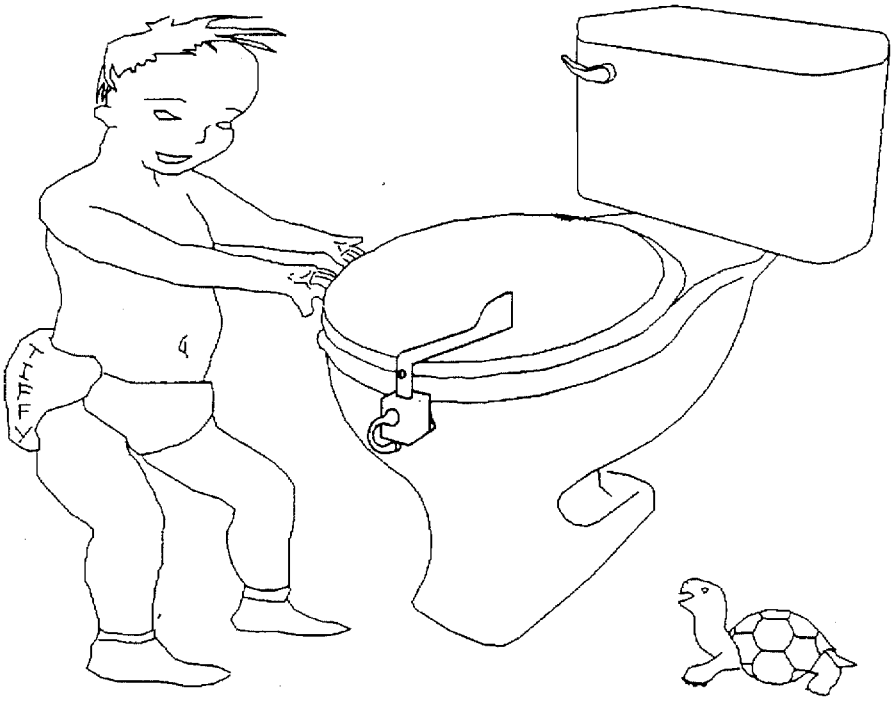
FIGS. 3A and 3B show the device mounted on a toilet for locking and/or latching the lid in the closed position to prevent access to the bowl's interior by a small child, pet, etc.
Figure 3B:
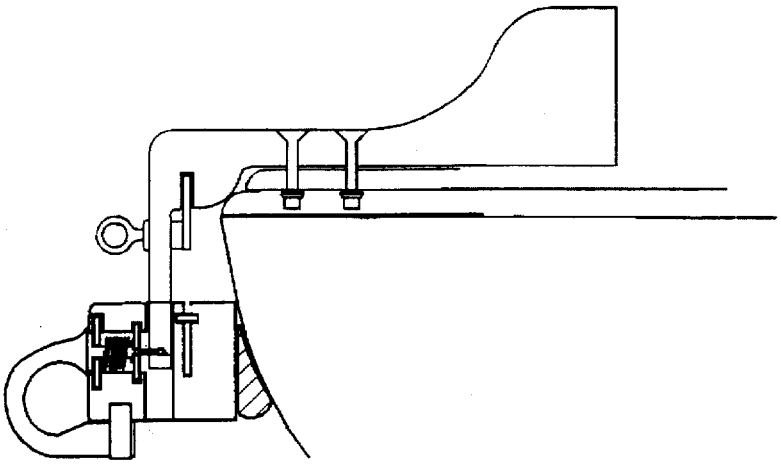

As shown in the drawings, the preferred toilet-lid closing and lock-down device with optional use key lock-down for use on many different types, and styles of toilets in accordance with the present invention includes complete device being placed on toilet-lid, and toilet-bowl where device will be mounted, and erasable outline made, then device removed.

Component #1 is a top mounted toilet-lid irregular shaped component which preferably is of strong molded plastic material, that acts as toilet-lid upward travel limiter, and at other end which extends over, and down toilet-lid and toilet-bowl acts as connector rod(3) which connects component #1, and component #2 when toilet-lid is in normal down position with optional use key lock-down, connector rod(3) with taper passage(4) local hole(5) through connector rod(3) at top of taper passage(4) mounting holes(6) through component #1 which accepts bolts(7) are placed in mounting holes(6) in component #1 through toilet-lid with washer(8), lock washer(9), nuts(10), and tighten to reasonable torque.

Above the lock hole(5) on connector rod(3) a key lock(11) is mounted with key(12), on back side of key lock(11) a lever or locking cam with notch-out(13) is attached to key lock(11) and unlock lever with notch-out(13) is positioned in slot(14), when key lock( 11 ) has key(12) inserted, and locked, lever with notch-out(13) is positioned in slot(15).

Component #2 which is a two pieced glued rectangular shaped component which is preferable, is of strong molded plastic material that attaches to the side of toilet-bowl, with adhesive, comprising of moldable putty adhesive(16) which bonds component #2 to toilet-bowl and also created desired height and angle for proper acceptance of connector rod(3).

Inside component #2 cut-outs or second slot(17) are made to retain actuator(18) a cut-out or first slot(19) is made for connector rod(3) to fit into and moves actuator(18) back/out as taper passage(4) is traveled, and finally actuator(18) reaches lock hole(5) and with spring(27) pressure pushes/moves forward actuator(18) into lock hole(5), cut-out(21) is made to accept lever with notch-out(13) with a cut-out(22) made with a piece of strong metal(23) fitted in cut-out(22).

The actuator(18) is made of a handle(24) a shaft with a beveled end(25) a spring retainer(26) on shaft(25) a compression spring(27) that fits over shaft(25) and two retainers (28) that hold actuator (18) in proper place inside component #2, two cut-outs(29) are made at bottom of component #2 on either side of handle(24) and a retainer support(30) is fitted into cut-outs(29) thus giving support to lower handle(24).

I claim:

1. An adjustable toilet-lid closing and lock-down device for use with a toilet having a water holding tank, a bowl, a lid and a seat, the lock-down device comprising:

a first component mountable to the lid; a second component mountable to the bowl; said first and second components are adapted to coact between the lid and the bowl to close and latch the lid in a closed position;

said first component including a top portion and a connector rod extending perpendicular to the top portion, the top portion having a first section having means for mounting the first component to the lid, the connector rod having a distal end including a tapered passageway which extends past the lid to engage with the second component when the lid is in the closed position;

said second component including a housing having a top, a bottom, and four sides, a first slot extending longitudinally through the housing between the top and the bottom, said housing to be aligned on the bowl such that the first slot is aligned to accept said connecting rod when the lid is moved to the closed position; a second slot extending perpendicular to and intersecting with the first slot, an actuator movable in the second slot and having an end extending into the first slot, said actuator being movable upon engagement with the end of the connector rod; said actuator being movable into the tapered passageway of said connector rod to latch the connector pin to the housing in response to the lid moving to the closed position.

2. The lock-down device of claim 1 further comprising:

a handle extending from one side of the housing for moving the actuator out of engagement with the tapered passageway of the connector rod to unlatch the first component from the second component.

3. The lock-down device of claim 1 wherein the actuator includes a handle, a shaft with a beveled end, a spring retainer on said shaft; a spring member fitting over said shaft, and at least one retainer that holds said actuator inside said component.

4. The lock-down device of claim 1 further comprising:

a locking mechanism mounted through an opening in the connector rod, said locking mechanism rotatable between a locked and a unlocked position, said locking mechanism having a lock cylinder and a locking cam mounted on the lock cylinder; said locking cam extending transverse to the longitudinal axis of the lock cylinder, said second component having an opening parallel to and spaced from the first slot;

wherein the first component is locked with a key to the second component when the lid is in the closed position and the locking mechanism is rotated to the locked position such that the locking cam is extended into the opening.

5. The lock-down device of claim 1 further comprising:

the top portion having a second section which projects upwardly from the first section; said second section adapted to contact the tank and prevent the lid from being placed in a open position.

6. An adjustable toilet-lid closing and lock-down device for use with a toilet having a water holding tank, a bowl, a lid and a seat, the lock-down device comprising:

a first component mountable to the lid; a second component mountable to the bowl; said first and second components are adapted to coact between the lid and the bowl to close and lock the lid in a closed position;

said first component having an irregular L-shape and including a top portion and a connector rod extending perpendicular to the top portion, the top portion having a first section with two apertures which extend through the top and are adapted to accept fasteners for mounting the first component to the lid, the connector rod having a distal end including a tapered passageway which extends past the lid to engage with the second component;

said second component including a housing having a top, a bottom, and four sides, a first slot extending longitudinally through the housing between the top and the bottom, said housing being aligned on the bowl such that the first slot is aligned to accept said connecting rod when the lid is moved to the closed position; a second slot extending perpendicular to and intersecting with the first slot, an actuator slidably mounted in the second slot and having an end extending into the first slot, said actuator slidably engaging the tapered passageway of said connector rod to lock the connector pin to the housing in response to the lid moving to the closed position; a handle extending from one side of the housing for moving the actuator out of engagement with the tapered passageway of the connector rod to unlock the first component from the second component.

7. An adjustable toilet-lid closing and lock-down device for use with a toilet having a water holding tank, a bowl, a lid and a seat, the lock-down device comprising:

a first component mountable to the lid; a second component mountable to the bowl; said first and second components are adapted to coact between the lid and the bowl to close and lock the lid in a closed position;

said first component having an irregular L-shape and including a top portion and a connector rod extending perpendicular to the top portion, the top portion having a first section with two apertures which extend through the top and are adapted to accept fasteners for mounting the first component to the lid, the top portion having a second section which projects upwardly from the first section; said second section adapted to contact the tank and prevent the lid from being placed in a open position; the connector rod having a distal end including a tapered passageway which extends past the lid to engage with the second component;

said second component including a housing having a top, a bottom, and four sides, a first slot extending longitudinally through the housing between the top and the bottom, said housing being aligned on the bowl such that the first slot is aligned to accept said connecting rod when the lid is moved to the closed position; a second slot extending perpendicular to and intersecting with the first slot, an actuator slidably mounted in the second slot and having an end extending into the first slot, said actuator slidably engaging the tapered passageway of said connector rod to lock the connector pin to the housing in response to the lid moving to the closed position; a handle extending from one side of the housing for moving the actuator out of engagement with the tapered passageway of the connector rod to unlatch the first component from the second component; said handle being rigidly attached to said actuator, said actuator having a shaft with a beveled end, a spring retainer on said shaft; a spring member fitting over said shaft, and at least one retainer that holds said actuator inside said component;

a locking mechanism mounted through an opening in the connector rod, said locking mechanism rotatable between a locked and a unlocked position, said locking mechanism having a lock cylinder and a locking cam mounted on the lock cylinder; said locking cam extending transverse to the longitudinal axis of the lock cylinder, said first component having a bottom portion connecting said top portion to said connecting rod; said bottom portion having a slotted opening for accepting the locking cam in the unlocked position;

said second component having a second slotted opening parallel to and spaced from the first slot;

wherein the first component is locked with a key to the second component when the lid is in the closed position and the locking mechanism is rotated to the locked position such that the locking cam is extended into the second slotted opening.

* * * * *